United States Patent [19]

Muenter et al.

[11] Patent Number: 5,051,341

[45] Date of Patent: Sep. 24, 1991

[54] COLOR IMAGING PROCESS AND APPARATUS

[75] Inventors: Annabel A. Muenter; James C. Owens, both of Rochester, N.Y.

[73] Assignee: Eastman Kodak Company, Rochester, N.Y.

[21] Appl. No.: 424,857

[22] Filed: Oct. 20, 1989

[51] Int. Cl.[5] ..... G03C 7/00

[52] U.S. Cl. ..... 430/359; 430/30; 430/357; 430/363; 430/383; 430/391; 355/35

[58] Field of Search ..... 430/30, 357, 359, 363, 430/383, 391; 355/35

[56] References Cited

U.S. PATENT DOCUMENTS

| | | | |
|---|---|---|---|
| 3,937,573 | 2/1976 | Rising | 355/83 |
| 3,977,872 | 8/1976 | Hellmig | 96/98 |
| 4,058,828 | 11/1977 | Ladd | 358/80 |
| 4,272,186 | 6/1981 | Plummer | 355/34 |
| 4,416,522 | 11/1983 | Webster | 354/4 |
| 4,619,892 | 10/1986 | Simpson et al. | 430/505 |
| 4,711,838 | 12/1987 | Grezeskowiak et al. | 430/568 |
| 4,731,671 | 3/1988 | Alkofer | 358/284 |
| 4,760,458 | 7/1988 | Watanabe et al. | 358/256 |
| 4,770,978 | 9/1988 | Matsuzaka et al. | 430/363 |
| 4,821,113 | 4/1989 | McQuade et al. | 358/75 |
| 4,824,770 | 4/1989 | Kitchin et al. | 430/363 |

OTHER PUBLICATIONS

Journal of Imaging Technology, vol. 14, No. 3, Jun. 1988, pp. 78–89.

*Primary Examiner*—Charles L. Bowers, Jr.

*Assistant Examiner*—Janis L. Dote

*Attorney, Agent, or Firm*—Joshua G. Levitt

[57] ABSTRACT

There is described a process for recording a positive or negative continuous tone color copy having the same or lower contrast than a continuous tone original image, comprising the steps of:

providing a photographic element comprising a support having thereon a silver halide emulsion unit capable of forming a yellow image, a silver halide emulsion unit capable of formign a cyan image, and a silver halide emulsion unit capable of forming a magnenta image, each image-forming unit having a maximum spectral sensitivity at a different wavelength of radiation, and at least one of the image-forming units having a gamma as described herein, receiving image data representing the densities of the yellow, magenta, and cyan records of the original image, modifying said image data and using it to control three exposure sources, each emitting radiation in the region of maximum spectral sensitivity for a corresponding one of the image-forming units, so that, after exposure, the recorded image density range for at least one of the yellow, magenta, and cyan image-forming units is substantially the same as or lower than the image density range for the corresponding yellow, magenta, and cyan records, respectively, of said original image, and exposing said photographic element to said exposure sources.

12 Claims, 7 Drawing Sheets

DENSITY
3.0
2.0
1.0
Log E
1.0
2.0
3.0
4.0
100
110
130
140

COLOR IMAGING PROCESS AND APPARATUS

FIELD OF THE INVENTION

This invention relates to photography, and specifically to a process for recording a continuous tone color image.

BACKGROUND OF THE INVENTION

In silver halide photography, continuous tone images are traditionally formed by exposing a photographic element to an image and developing the element to form a corresponding image therein. In black and white photography, the element's image will usually be of a single record. In color photography, the element's corresponding image is usually made up of three records: a yellow record, a magenta record, and a cyan record, corresponding to the blue, green, and red portions of the original image.

Photographic elements are generally of two types: negative or reversal. For either of these types, it is often desirable to produce a negative or positive copy. This copying is done by exposing a second photographic element with light that is transmitted through a previously exposed and processed first element made on transparent base or with light that is reflected from a previously exposed and processed first element made on a reflective base. The second element is then developed to yield the copy.

The ability of a photographic element, such as the second photographic element described above, to reproduce the contrast, i.e., the range of image densities, of an image is usually determined by the slope of the straight-line portion of the characteristic curve, i.e., the D-Log E curve (a plot of image density versus log exposure). This slope is referred to as gamma and is a measure of the contrast characteristics of a photographic element. "Contrast" will be used herein to refer to the qualitative appearance of the image, as opposed to other usages in the art where contrast has sometimes been used interchangeably for gamma. Another way to quantify the contrast of an image, independent of gamma, is by the range of densities found in the image. A lower contrast image will typically have a lower image density range than a higher contrast image.

If it is desired to replicate the contrast of an image, a photographic element having a gamma with an absolute value of approximately unity is used. When it is desired to produce a photographic copy having a lower contrast than the original image, a photographic element having a gamma with an absolute value of less than 1 is used. Similarly, a photographic element having a gamma with an absolute value of greater than 1 is used to produce a photographic copy having greater contrast than the original. These three scenarios are illustrated in FIGS. 1-3, as described below.

FIGS. 1-3 are four-quadrant objective tone scale reproduction diagrams, similar to those shown in B. Carroll, G. Higgins, and T. James, Introduction to Photographic Theory, chapt. 5, Wiley Publ., New York, 1980. FIG. 1 represents the matched-contrast scenario, FIG. 2 represents the reduced-contrast scenario, and FIG. 3 represents the increased-contrast scenario. In each of these Figures, the image density range of the original is represented on the horizontal axis at the top of Quadrant 1 (Q1). The densities represented by this range are the input data for lines 11, 21, and 31 of FIGS. 1, 2, and 3, respectively. Line 11, 21, or 31 is a straight line having a slope of $-1$, performing the function of mapping the input data representing the densities of the original from Quadrant 1 into Quadrant 2 (Q2). Line 12, 22, or 32 in Quadrant 2 is a line having a slope of 1, representing the mapping of the density input from the original to a log exposure output that is provided to the photographic element onto which the copy is made. Curves 13, 23, and 33 in Quadrant 3 (Q3) represents the characteristic D-Log E curve of a negative-working photographic element onto which the copy is made. In the matched contrast scenario represented by FIG. 1, curve 13 has a straight-line slope (i.e., gamma) of 1. In the reduced-contrast scenario represented by FIG. 2, curve 23 has a straight-line slope (i.e., gamma) of less than 1. In the increased-contrast scenario represented by FIG. 3, curve 33 has a straight-line slope (i.e., gamma) of greater than 1. The input log exposure values are mapped through curves 13, 23, and 33 to give the densities of the final copy image on the vertical axis between Quadrants 3 and 4. These D-log E curves must have straight-line portions long enough to cover the density range of the original image. Line 14, 24, or 34 in Quadrant 4 (Q4) is a straight line having a slope of 1, which performs the function of mapping the densities of the copy image onto the horizontal axis at the top of Quadrant 1, so that the density range of the copy can be compared with the density range of the original. The above-described mapping operations are represented by dotted lines 15, 25, and 35, and dashed lines 16, 26, and 36. These lines map a representative low and a representative high density on the original, through Quadrants 1, 2, 3, and 4 in the direction of the arrows shown on lines 15, 25, 35, 16, 26, and 36, ending up as densities on the copy on the horizontal axis at the bottom of Quadrant 4. In the matched contrast scenario represented by FIG. 1, it is seen that the density range of the copy is the same as the density range of the original. In the reduced-contrast scenario represented by FIG. 2, it is seen that the density range of the copy is smaller than the density range of the original. In the increased-contrast scenario represented by FIG. 3, it is seen that the density range of the copy is greater than the density range of the original.

When it is desired to make a photographic copy of an original image having the same or reduced contrast as the original image, the photographic element onto which the copy is made traditionally must have a gamma with an absolute value of less than or equal to about 1. In order to achieve a satisfactory D-max in an element with a gamma of 1 or less, the emulsion system used in the element must have a broad exposure latitude. When relatively monodispersed emulsions are used, it is often necessary to use multiple emulsions having substantially the same spectral sensitivity but different speeds to achieve the needed latitude. This is illustrated in FIG. 4, where curve 100 represents a faster, short-latitude emulsion having larger grain sizes, curve 110 represents a slower, short-latitude emulsion having smaller grain sizes, curve 130 represents the additive latitude-broadening effect of the two emulsions. Curve 140 represents a single short-latitude emulsion that achieves the desired D-max, but which necessarily has a high gamma that would not produce a copy having a contrast that is the same as or lower than the original.

The necessity of multiple silver halide emulsions for each region of spectral sensitivity increases the complexity, difficulty of preparation, and expense of the photographic element, whether they are coated in separate layers or blended together in a single layer. Moreover, the presence of larger silver halide grains that are especially prevalent in the faster emulsions can lead to light scattering, which reduces the sharpness of the image produced in the element.

An alternate method for achieving the latitude needed to give a desired D-max with a relatively low gamma is to use a highly polydisperse emulsion. However, such highly polydisperse emulsions are difficult to chemically and spectrally sensitize in an optimum fashion, since each of the grain size classes within the emulsion is likely to require a different concentration of reagents to achieve this optimum sensitization. Consequently, the speed/fog characteristics of such emulsions are frequently inferior to monodisperse emulsions. In addition, reproducible precipitation of a highly polydisperse emulsion is often more difficult than reproducible precipitation of monodisperse emulsion. Further, the population of larger grains that are present in highly polydisperse emulsions will contribute to additional light scattering, again reducing the sharpness of the image produced in the element.

It would thus be desirable to produce color copies having the same as or lower contrast as an original image using a photographic element that does not require either multiple silver halide emulsions for each region of spectral sensitivity or highly polydisperse emulsions, and their associated disadvantages. As described above, such an element necessarily has a high gamma (over 1), which, using prior art processes, would produce an image having not the desired same or lower contrast, but an undesired greater contrast than the original image.

SUMMARY OF THE INVENTION

Such copies having contrast that is the same as or lower than the original image are, however, provided by the present invention.

According to the invention, there is provided a process for recording a positive or negative continuous tone color copy having substantially the same contrast as a continuous tone original image, comprising the steps of:

providing a photographic element comprising a support having thereon a silver halide emulsion unit capable of forming a yellow image, a silver halide emulsion unit capable of forming a cyan image, and a silver halide emulsion unit capable of forming a magenta image, each image-forming unit having a maximum spectral sensitivity at a different wavelength of radiation, and at least one of the image-forming units having a gamma of greater than about 1.5, receiving image data representing the densities of the yellow, magenta, and cyan records of the original image, modifying said image data and using it to control three exposure sources, each emitting radiation in the region of maximum spectral sensitivity for a corresponding one of the image-forming units, so that the image density range for at least one of of the yellow, magenta, and cyan image-forming units is substantially the same as the image density range for the corresponding yellow, magenta, and cyan records, respectively, of said original image, and exposing said photographic element to said exposure sources.

In another embodiment of the invention, there is provided a process for recording a positive or negative continuous tone color copy having lower contrast than a continuous tone original image, comprising the steps of:

providing a photographic element comprising a support having thereon a silver halide emulsion unit capable of forming a yellow image, a silver halide emulsion unit capable of forming a cyan image, and a silver halide emulsion unit capable of forming a magenta image, each image-forming unit having a maximum spectral sensitivity at a different wavelength of radiation, and at least one of the image-forming units having a gamma of greater than about 1.0, receiving image data representing the densities of the yellow, magenta, and cyan records of the original image, modifying said image data and using it to control three exposure sources, each emitting radiation in the region of maximum spectral sensitivity for a corresponding one of the image-forming units, so that the image density range for at least one of the yellow, magenta, and cyan image-forming units is about 0.1 to 0.9 times the image density range for the corresponding yellow, magenta, or cyan records, respectively, of said original image, and exposing said photographic element to said exposure sources.

The present invention provides a photographic copy having the same or lower contrast than the original image. The photographic element onto which the copy is made does not require highly polydisperse silver halide emulsions or multiple silver halide emulsions for each region of spectral sensitivity, yet it still offers satisfactory D-max. This is in contrast to prior art processes, where, when it was desired to make copies having the same or lower contrast than the original, achievement of the exposure latitude and D-max required to make a faithful copy required the use of multiple emulsions or highly polydisperse emulsions and their associated disadvantages.

DESCRIPTION OF THE PREFERRED EMBODIMENTS

Figure 1:
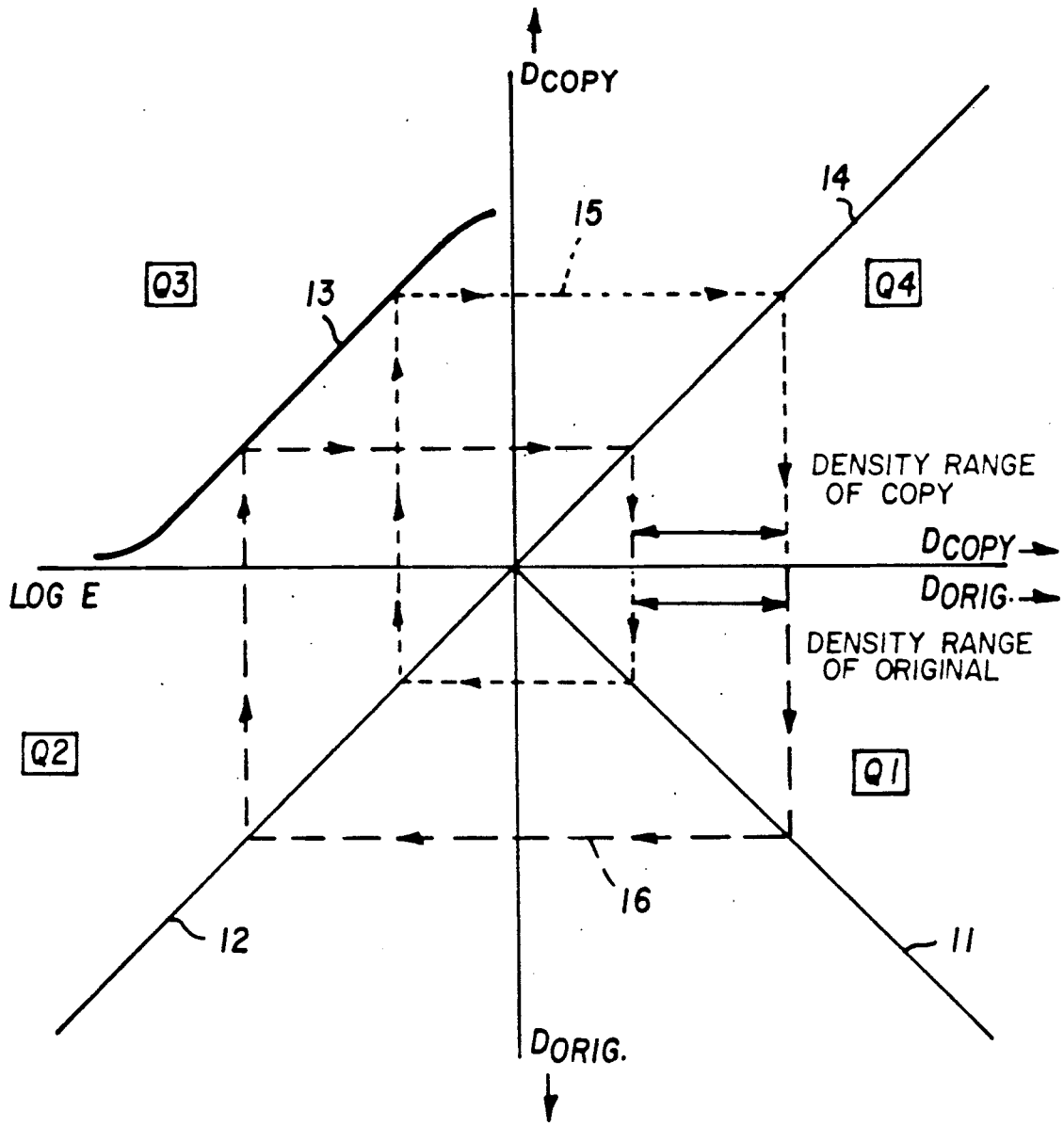
FIGS. 1, 2, and 3 are objective tone reproduction diagrams representing prior art processes for producing copies having a contrast that is the same, lower, or higher, respectively, than the original image.

The present invention is directed to recording a continuous tone color copy of an original image, with the copy having a contrast that is the same as or lower than the original. What is meant by this is that the image density range for the copy is the same as or less than the image density range of the original image. This range is defined as the maximum image density (image D-max) minus the minimum image density (image D-min). By maximum and minimum image densities is meant the maximum and minimum densities providing usable image detail. In some cases, the original image may include a background density which differs from that in the copy or vice versa. Since both the minimum image density and the maximum image density include this background density, the difference between the minimum image density and the maximum image density (the density range) is independent of the magnitude of the background density. For example, in color negative film, colored masking couplers are often used to correct for unwanted absorbance of image dyes. These masking couplers generally impart an orange-colored minimum density to the developed negative film. However, the background density imparted by the masking couplers would cancel out when the density range in the image was computed.

Providing a copy having the same image density range as the original will usually result in the copy having the same contrast as the original. This may not be true, however, in certain limited situations. For example, if the algorithm chosen to modify the image data produced the same minimum and maximum densities in the copy as the original, but produced the midscale densities at higher densities than in the original, the contrast in the lower scale of the copy would be higher than in the original and the contrast in the upper scale of the copy would be lower than in the original. Thus, in a preferred embodiment of the invention, the modified image data is used to control the exposure sources so that not only the image density range, but also the distribution of the differences in image density from the mean value of image density, or the distribution of these differences with reversed sign (thus reversing the polarity of the image but leaving it unchanged in absolute value of contrast) for at least one of the yellow, magenta, and cyan image-forming units is substantially the same as the distribution of image density differences from the mean for the corresponding yellow, magenta, and cyan records, respectively, of the original image.

Similarly, providing a copy having an image density range that is some specified fraction of the image density range in the original will usually result in a copy having a contrast which is reduced by this factor compared to the original. However, as described above, certain image data-modifying algorithms could result in distortions in the contrast of the copy. Consequently, in a preferred embodiment, the modified image data is used to control the exposure sources so that not only the image density range, but also the distribution of the differences in image density from the mean value of image density or the distribution of these differences with reversed sign (thus reversing the polarity of the image but leaving it unchanged in absolute value of contrast) for at least one of the yellow, magenta, and cyan image-forming units is some specified fraction of the distribution of image density differences from the mean for the corresponding yellow, magenta, and cyan records, respectively, of the original image.

Photographic elements useful in the practice of this invention comprise a support having thereon a yellow image-forming silver halide emulsion unit, a magenta image-forming silver halide emulsion unit, and a cyan image-forming silver halide emulsion unit. Each of these units is made up of one or more silver halide emulsion layers. To take maximum advantage of the invention, it is preferred that each unit has only one layer, but the invention is not limited to such one-layer units.

The support of the element of the invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure*, December, 1978, Item 17643 [hereinafter referred to as *Research Disclosure I*], Section XVII.

The silver halide emulsions can contain, for example, silver bromide, silver chloride, silver iodide, silver chlorobromide, silver chloroiodide, silver bromoiodide, or mixtures thereof. The emulsions can include any of the known grain configurations, such as coarse, medium, or fine silver halide grains bounded by 100, 111, or 110 crystal planes. Silver halide emulsions and their preparation are further described in *Research Disclosure I*, Section I. Also useful are tabular grain silver halide emulsions, such as those described in *Research Disclosure*, January, 1983, Item 22534 and U.S. Pat. No. 4,425,426. The silver halide emulsions may be sensitized with chemical sensitizers such as sulfur compounds, selenium compounds, gold compounds, iridium compounds, or other group VIII metal compounds, as is known in the art.

Each of the silver halide emulsion units useful in the practice of the invention has a maximum spectral sensitivity at a different wavelength of radiation, such as the red, blue, or green portions of the visible spectrum, or to other wavelength ranges, such as ultraviolet, infrared, X-ray, and the like. In a preferred embodiment of the invention, each unit has a maximum spectral sensitivity in the red to infrared portion of the spectrum, which allows the exposure sources to be solid state light-emitting diodes (LED's) or solid state infrared lasers. The effectiveness of red and infrared-sensitizing dyes can be improved with bis-azine compounds, as described, for example in U.S. Pat. No. 4,199,360. Spectral sensitization of silver halide can be accomplished with spectral sensitizing dyes such as cyanine dyes, merocyanine dyes, styryls, or other known spectral sensitizers. Additional information on sensitization of silver halide is described in *Research Disclosure I*, Sections I–IV.

Filter dyes may also be used in the element of the invention. Typical known uses of filter dyes include as interlayer dyes, trimmer dyes, or antihalation dyes. They can be used to improve image separation by preventing unwanted blue light from reaching the green-sensitive emulsion layer of a multicolor photographic element (the same principle can be applied when each of the silver halide emulsion units is different to a different portion of the infrared spectrum, as described in U.S. Pat. No. 4,619,892), and other uses as indicated by the absorbance spectrum of the particular dye. Filter dyes can be used in a separate filter layer or as an intergrain absorber.

The silver halide emulsion units of the element useful in the practice of the invention are each capable of forming a yellow image, a magenta image, or a cyan image, respectively. These images are formed by dye-forming couplers that react with oxidized color developer to form dye. The color developer is oxidized imagewise by reaction with exposed silver halide in each of the units. Color dye-forming couplers are well-known in the art and are further described in *Research Disclosure I*, Section VII.

The element useful in the practice of the invention can also include any of a number of other well-known additives and layers, as described in *Research Disclosure I*. These include, for example, optical brighteners, antifoggants, image stabilizers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

The process and apparatus of the invention record onto the silver halide photographic element a latent image that produces a continuous tone copy of the original upon processing. Processing can be by any type of known photographic processing, as described in *Research Disclosure I*, Sections XIX—XXIV. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

At least one of the image-forming units of the element useful in the practice of the invention has a gamma that would be inconsistent with producing the desired copy having a contrast, or image density range, that is the same as or lower than the original image. In the case where a copy is desired having substantially the same image density range as the original, at least one of the image-forming units has a gamma of greater than about 1.5, and preferably greater than about 2.0. In the case where a copy is desired having the an image density range that is 0.1 to 0.9 times the image density range of the original, at least one of the image-forming units has a gamma of greater than about 1.0, and preferably greater than about 1.5.

Gamma is defined as the slope of the straight-line portion of the characteristic curve of a given imaging unit in the photographic element. In some instances, such as where the straight-line portion is very short, it is contemplated that equivalents of gamma can be used. Such equivalents include contrast index (see Encyclopedia of Practical Photography, vol. 4, pp. 594–597, American Photographic Book Publ. Co., 1978) or the mean gradient of the useful portion of the characteristic curve (see B. Carroll, G. Higgins, & T. James, Introduction to Photographic Theory, pp. 5, 36 (Wiley, New York, 1980). In either case, the mathematical value of gamma may be either positive (for negative working materials) or negative (for reversal materials). As used herein, gamma values are the absolute value numbers, as the invention applies equally as well to positive or negative copies.

Silver halide emulsions having specified gammas can be prepared by techniques known in the art. The gamma of a silver halide emulsion depends primarily on the distribution and range of grain sizes in the emulsion, i.e., the "polydispersity" of the emulsion. Emulsions that are more polydisperse tend to have lower gammas whereas emulsions that are more monodisperse tend to have higher gammas. Emulsion precipitation techniques yielding varying degrees of polydispersity and varying gammas are known in the art, as described, for example, in *Research Disclosure I*, Section I, and James, *The Theory of the Photographic Process*, ch. 3, MacMillan, 1977.

The image data that is received according to the invention may come from any of a number of well-known sources. This includes signals such as those from a scanner that reads density data from a hard copy original image, such as a photograph or drawing; signals from an electronic camera; or signals from computer-generated graphics or drawings. Although electronic cameras generally provide data representing the red, green and blue luminance values of an original scene, this data must be translated so as to represent the cyan, magenta, and yellow densities necessary to reproduce a hard copy of the scene. In a preferred embodiment, however, the original image is itself a hard copy and the data to be received is generated by a scanner or reader as is known in the art. Such devices generally comprise a light sensor and a color light source (e.g., a white light source and a color filter wheel containing red, blue, and green filters). Alternatively, a white light source and an array of color sensors could be used. Examples of such useful devices include CRT scanners, drum scanners, flat bed scanners, area image scanners, line sensors, flying spot scanners, and others as described in J. Milch, "Image Scanning and Digitization", ch. 10, in *Imaging Processes and Materials*, pp. 292–322, (J. Sturge ed., 1989.) Image data may be received directly from a scanner, but it is preferable in some instances (e.g., where the speed of the scanner is limited) to store the data (e.g., in a frame store) before it is received by the process and apparatus of the invention.

The present invention can be used to make copies of any original image. It is especially useful, however, in making equivalent-contrast copies of low-contrast originals and reduced contrast copies of high-contrast originals. For example when a copy is desired having the same contrast as the original, the original is preferably a photographic element having a gamma of between about 0.5 and 1.1. Examples of this include duplicate copies that are used in the standard printing sequence for theatrical motion picture film production. When a copy is desired having lower contrast than the original, the original is preferably a photographic element having a gamma of greater than about 1.1, and more preferably greater than about 1.5. Such materials are generally likely to be transparency films or paper print materials from which it is often desirable to have a low contrast copy to use as an internegative image to produce further copy prints using conventional optical means.

A situation where the present invention can be particularly useful is when the image separation between the units of at least one set of two image-forming units in the element useful in the practice of the invention is less than about 1.7 log exposure units. Image separation is defined as the difference in speed observed between an imaging unit capable of forming a first desired color and any other imaging unit capable of forming an image of second color when the element is exposed with a wavelength or band of wavelengths at the maximum spectral sensitivity of the imaging layer producing the first color. Such elements are likely to require high gamma image-forming units in order to reduce "punch-through", a phenomenon where the exposure source for one of the image-forming units also results in exposure of one or more of the other image-forming units. Such high gamma image-forming units would not be capable of providing copies having contrast that is the same as or lower than the original image using prior art processes.

Figure 2:
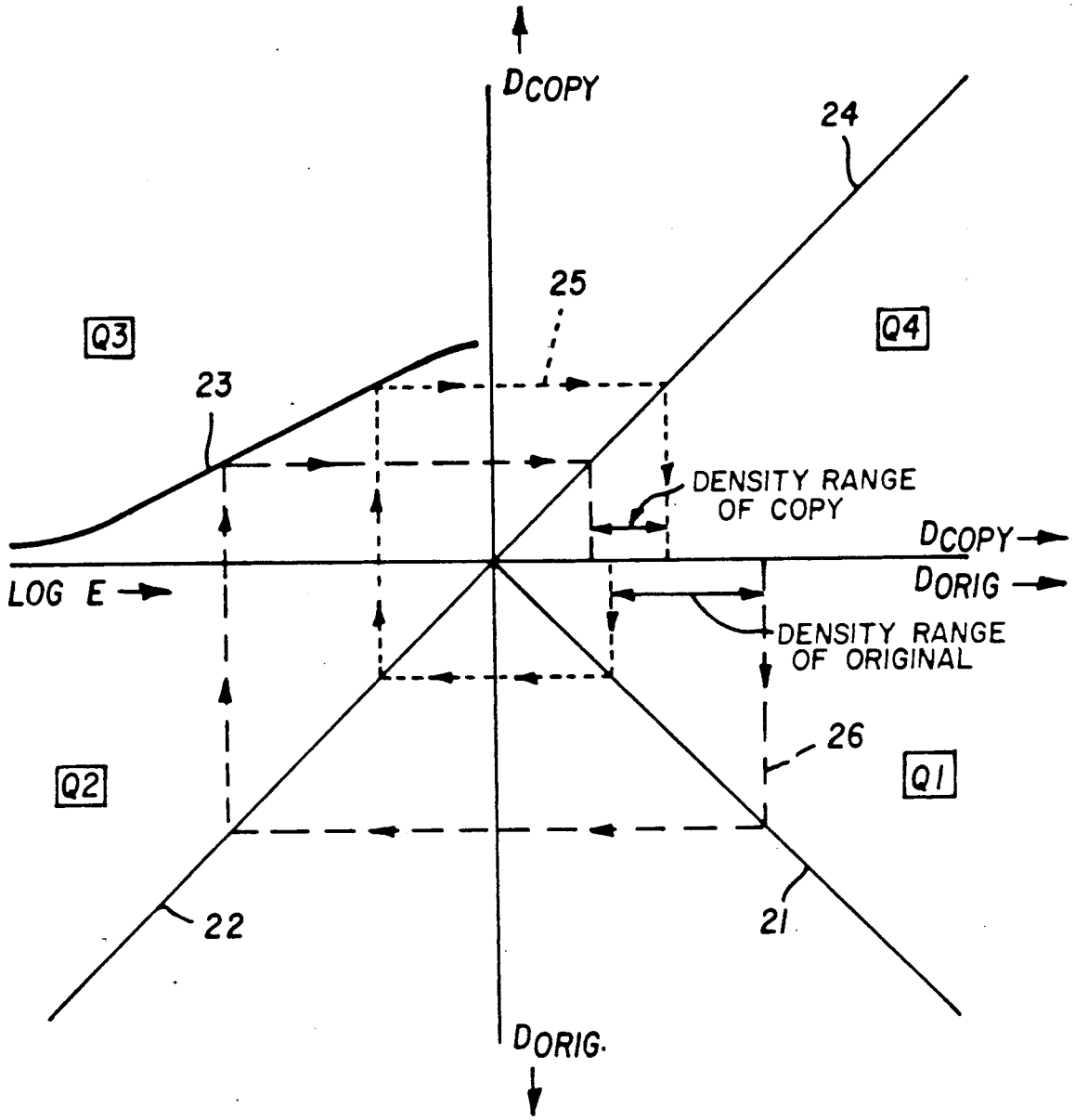
Figure 3:
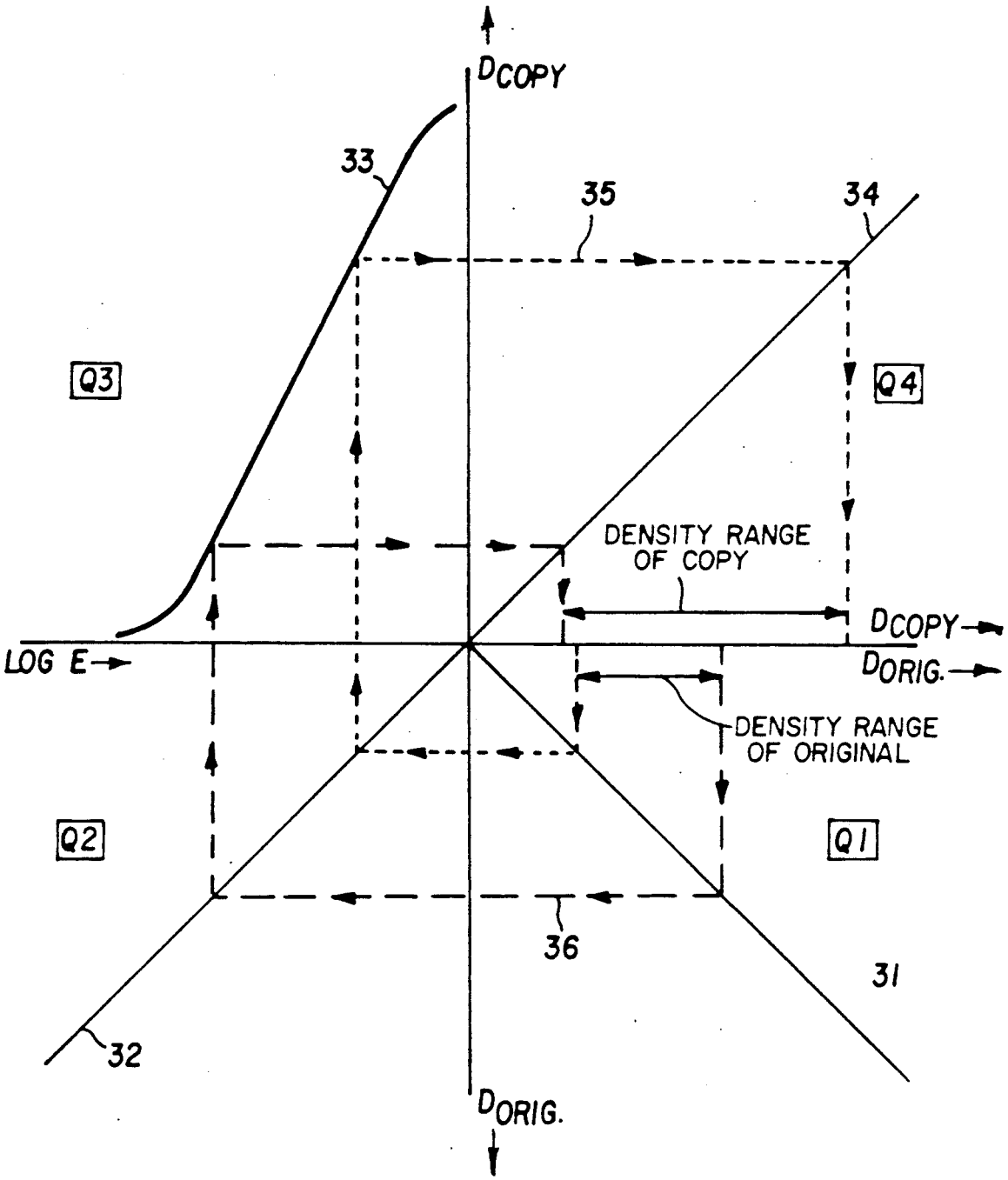
Figure 4:
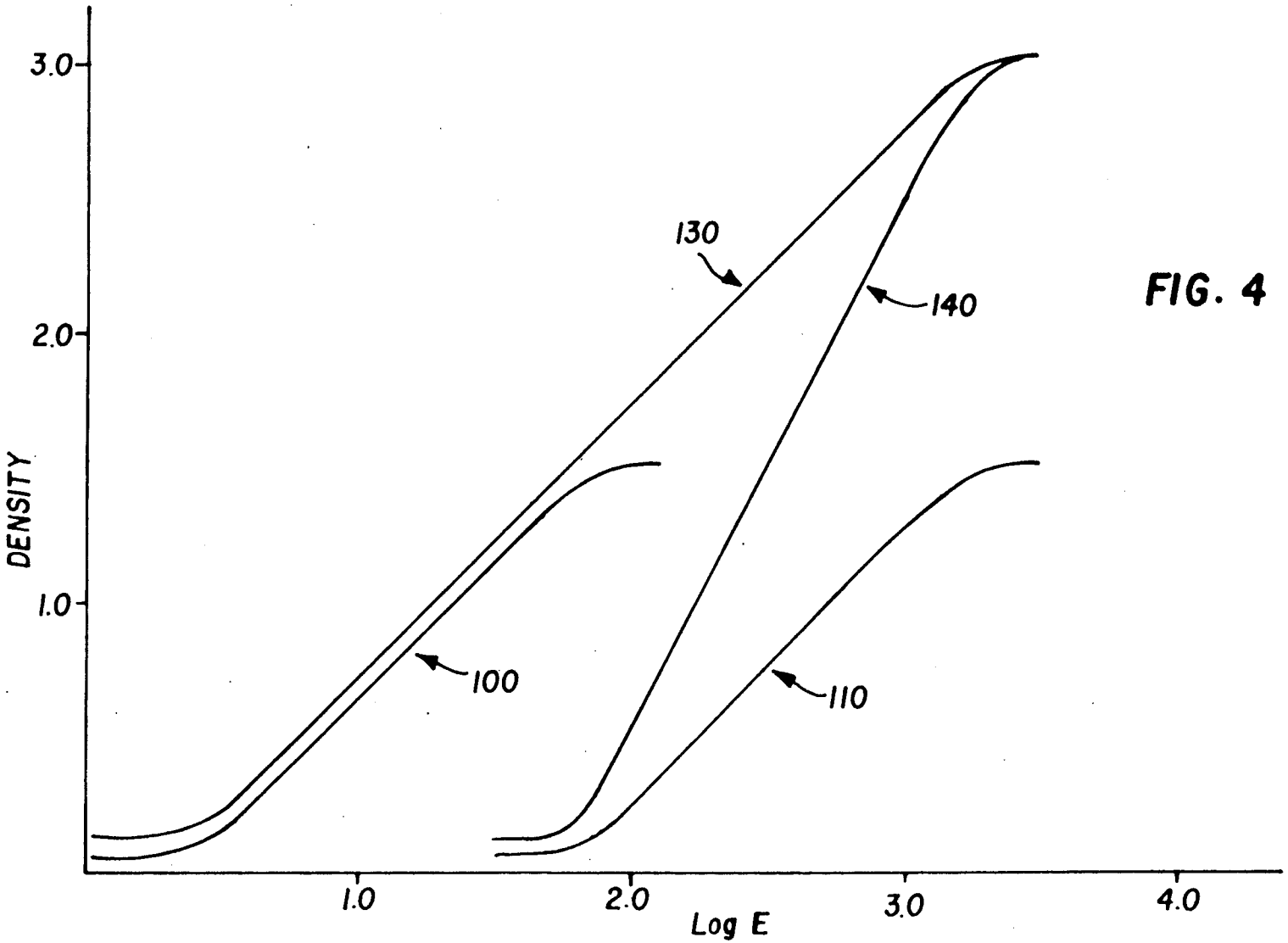
FIG. 4 shows characteristic curves for photographic emulsions, illustrating how broad latitude photographic elements are obtained.
Figure 5:
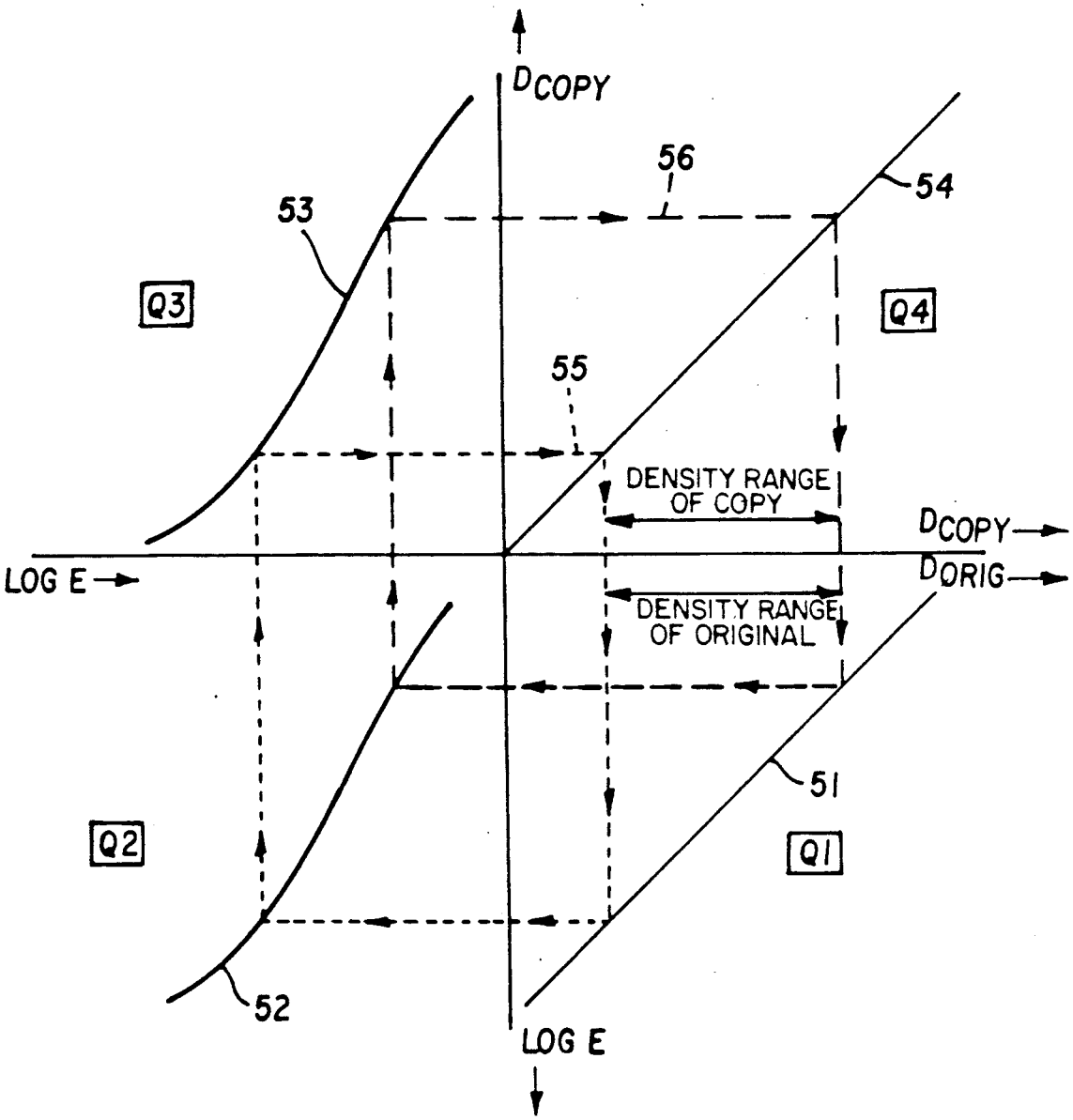
FIGS. 5 and 6 are objective tone reproduction diagrams representing the operation of the process of the invention for producing a matched or reduced contrast copy onto a high gamma photographic element.
Figure 6:
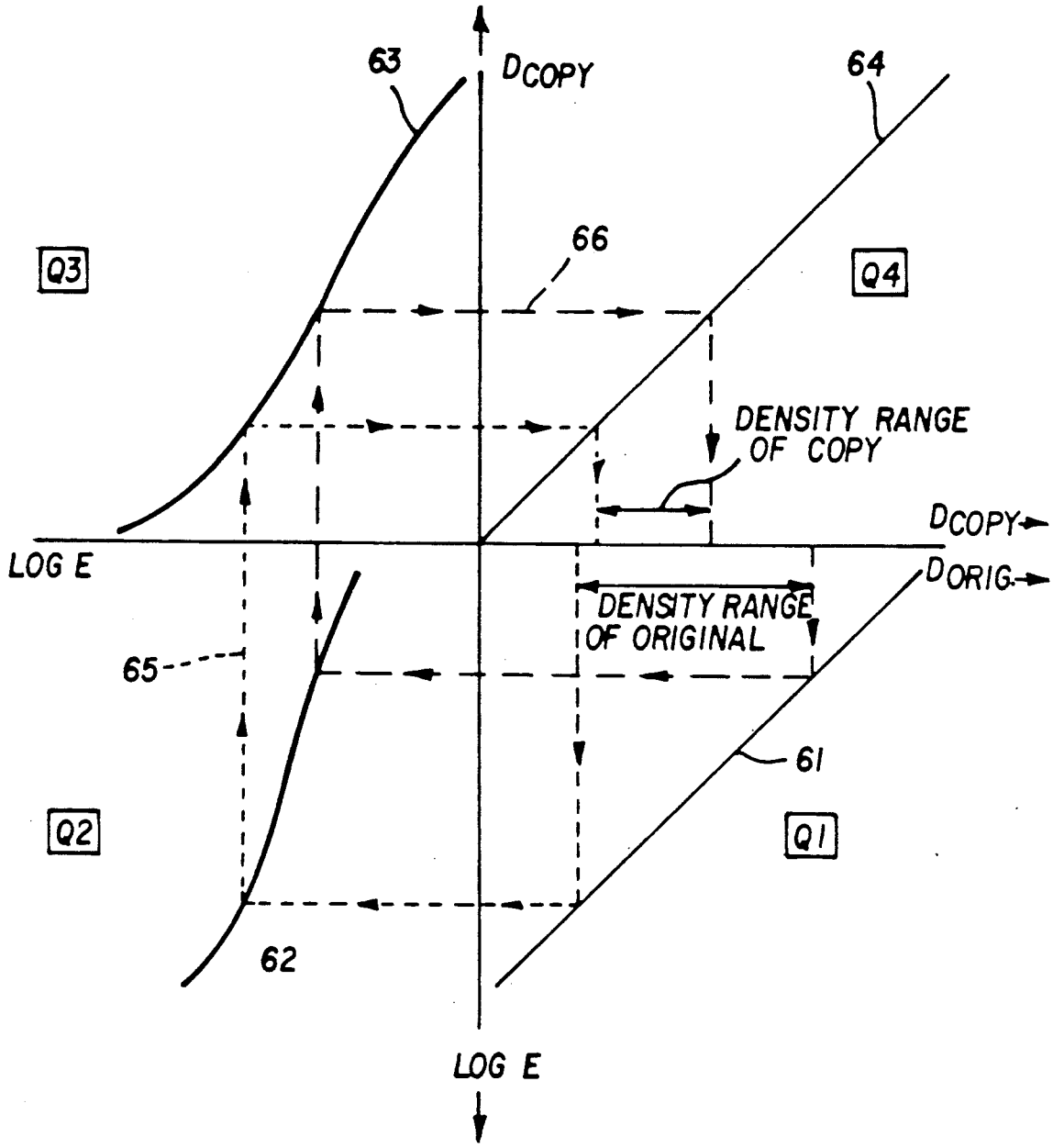

The manipulation of image data according to the present invention to modify contrast is further described by reference to FIGS. 5-6. FIGS. 5-6 are four-quadrant objective tone scale reproduction diagrams, similar to FIGS. 1-3, described above. FIG. 5 represents a matched-contrast scenario and FIG. 6 represents a reduced-contrast scenario. FIGS. 5-6, unlike FIGS. 1-3, utilize image data modification to provide matched or reduced contrast copies using a photographic element having a gamma of greater than unity. Such elements, when used in prior art processes, provided copies having greater contrast than the original. In FIGS. 5-6, the image density range for one of the three colors of the original is represented on the horizontal axis at the top of Quadrant 1 (Q1). The densities represented by this range are the input data for lines 51 and 61. Lines 51 and 61 are straight lines having a slope of $+1$ or $-1$, representing the choice of the polarity of the copy. A slope of $-1$ keeps the polarity of the image data the same while a slope of $+1$ (as shown in the figures) reverses the polarity of the image data. Lines 51 and 61 may also be offset vertically or horizontally to add or subtract a fixed background density for each color. The data representing the image densities of the original is mapped through lines 51 and 61 into Quadrant 2 (Q2), where it is input data for curves 52 and 62. Curves 52 and 62 represent the modification of the image data to control contrast. Its input (the vertical axis) is the density range of the original image, and its output (the horizontal axis) is the logarithm of the the exposure to be given the recording material. The output data from curves 52 and 62 is mapped into Quadrant 3 (Q3) where it is the input data for curves 53 and 63. Curves 53 and 63 in Quadrant 3 represent the characteristic D-Log E curve of a negative-working photographic element onto which the copy is made. In both FIGS. 5 and 6, curves 53 and 63 have a straight-line slope (i.e., gamma) of greater than unity, which would make them incapable of producing a matched or reduced contrast copy using prior art imaging processes. It should be noted that, unlike prior art conventional image copying processes which record image information utilizing only the straight-line portion of the characteristic curve, in this invention any portion of the curve may be utilized as long as its slope is greater than zero. Additionally, although curves 53 and 63 represent a negative working photographic element, the element may be either positive or negative working, as both types may be used to achieve, with an appropriate choice of slope for lines 51 and 61, either a same polarity (positive) or reversed polarity (negative) copy. The input log exposure values are mapped through curves 53 and 63 to give the densities of the final copy image on the vertical axis between Quadrants 3 and 4. Line 54 or 64 in Quadrant 4 (Q4) is a straight line having a slope of 1, which performs the function of mapping the densities of the copy image onto the horizontal axis at the top of Quadrant 1, so that the density range of the copy can be compared with the density range of the original. The above-described mapping operations are represented by lines 55, 56, 65, and 66. These lines map a representative low and a representative high density on the original, through Quadrants 1, 2, 3, and 4 in the direction of the arrows shown on lines 55, 56, 65, and 66, ending up as densities of the copy on the horizontal axis at the bottom of Quadrant 4. In the matched contrast scenario represented by FIG. 5, it is seen that the density range of the copy is the same as the density range of the original. In the reduced-contrast scenario represented by FIG. 6, it is seen that the density range of the copy is smaller than the density range of the original. These figures should be compared with the prior art process represented by FIG. 3, where the use of a photographic element having a gamma of greater than 1 necessarily resulted in an copy having increased contrast.

Figure 7:
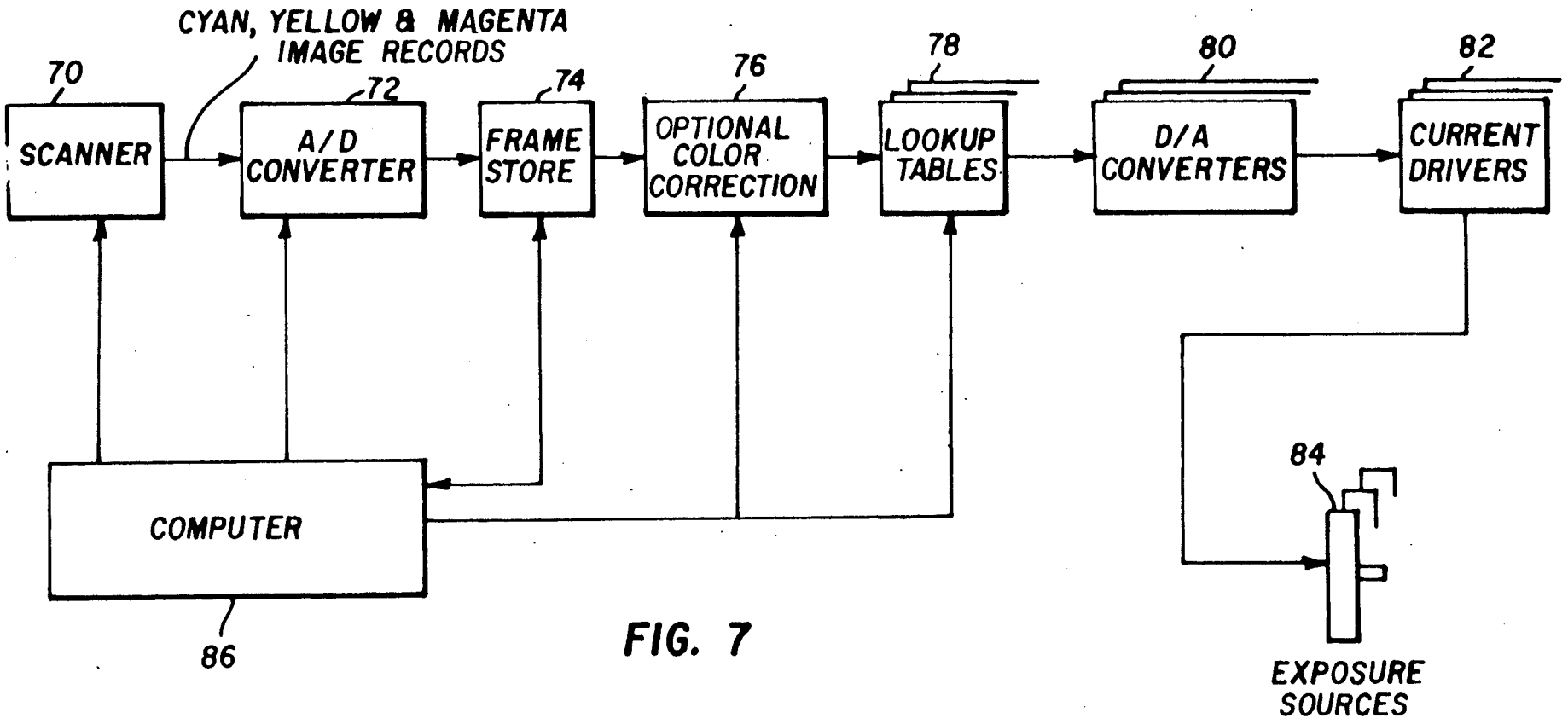
FIG. 7 is a block diagram representing a preferred process and apparatus according to the invention.

The process and apparatus of the invention, and their operation, is illustrated by FIG. 7, which represents one preferred embodiment of the invention. According to this figure, the original image is pixel-wise scanned by scanner 70, which generates image data representing the densities of the cyan, yellow, and magenta records for the original image. As the image is read, e.g., by scanning in raster fashion, the densities of the cyan, yellow, and magenta records for the original image are determined by subjecting each scanned pixel of the image to red, blue, and green light, upon which the light sensor generates an electrical signal representing the image data.

If the image data generated by reader 70 is in the form of an analog electrical signal, the signal is converted to a digital value by analog to digital converter 72. The number of bits utilized for each digital value should provide for a range of digital values sufficient to represent the number of exposure levels needed for the exposure sources to produce an image of acceptable continuous tone quality. The digital value provided by analog to digital converter 72 preferably has at least 8 bits (providing for 256 possible digital values), and more preferably has at least 12 bits (providing for 4096 possible digital values) or 14 bits (providing for 16384 possible digital values).

The image data thus generated is received by look-up tables 78. Scanner 70, analog to digital converter 72, frame store 74, and optional color correction 76 need not be part of the process and apparatus of the invention, but are included in FIG. 7 for illustrative purposes as to how the data can be generated. The data may be provided directly to look-up tables 78 by analog to digital converter 72, temporarily stored in frame store 74. The data may also be down-loaded to computer 86 for longer-term storage, such as on a magnetic tape or disk or optical disk, and loaded back into frame store 74 at some later time. Computer 86 can also provide control functions for scanner 70, analog to digital converter 72, frame store 74, as well as data entry and control function for optional color correction 76 and look-up tables 78.

Optional color correction 76 is provided by color matrixing, as is known in the art. Color matrixing is performed with a function as shown below:

$$\begin{bmatrix} Y_0 \\ M_0 \\ C_0 \end{bmatrix} = \begin{bmatrix} a_{Y1} & -b_{M1} & -c_{C1} \\ -a_{Y2} & b_{M2} & -c_{C2} \\ -a_{Y3} & -b_{M3} & c_{C3} \end{bmatrix} \begin{bmatrix} Y_i \\ M_i \\ C_i \end{bmatrix}$$

The color correction matrix shown above is a 3×3 matrix for first-order correction, which is generally sufficient to provide an average masking correction for the unwanted overlapping absorption of imaging dyes. Larger matrixes, such as a 3×10 matrix, may be used if it is desired to provide a better correction that compensates for the variation of unwanted absorption with exposure level.

In a preferred embodiment, this color correction is utilized to provide a masking correction. This is useful because the spectral ranges of absorption of the image dyes formed in silver halide photographic elements overlap and therefore, exposure of a given layer creates absorption not only of the desired color but also of other colors, resulting in dark and desaturated images. Masking by incorporation of colored couplers is often used in color negative photography to provide additional color density that is chemically removed by an appropriate amount during processing to compensate for the unwanted density of the image dyes, thus providing lighter and more saturated images. The additional density required for this correction can then be compensated for during later printing and copying processes. The process and apparatus of the present invention can advantageously utilize electronic masking to record either intermediate images (having electronically-added minimum density) or final, viewable images (having no added minimum density) on a single multipurpose silver halide photographic element that is substantially free of any colored masking couplers.

According to the invention, the image data is modified to control exposure sources so that the image density range for at least one of the records in the copy is substantially the same as the image density range for the corresponding record in the original image. This modification is accomplished in FIG. 7 by look-up tables 78. The look-up tables embody the image data modification (for tone scale adjustment) function represented by curves 52 and 62 in FIGS. 5 and 6. The use of look-up tables in image processing is well-known in the art. For each particular input digital value, one of the look-up tables will provide an output digital value, which, when converted to an analog signal by one of the digital to analog converters 80 and then a driving current by one of the current drivers 82, will cause one of the exposure sources 84 to provide sufficient exposure to the photographic element to record an image pixel that will contribute to an image having the desired image density range. The look-up tables thus take into account and compensate for any non-linearity in the response of the reader, the exposure source, or the photographic silver halide emulsion units. Also, because a separate look-up table is used for each of the cyan, yellow, and magenta image records, the characteristic curve shapes of the silver halide emulsion units in the photographic element do not have to match each other, as with conventional photographic printing processes. The values for the look-up tables are determined by simple calibration procedures involving exposing the photographic element using test signals and observing the image densities thereby produced.

The digital to analog converters 80 and current drivers 82 are well-known in the art and do not require further explanation here. The exposure sources 84 can be any of a number of well-known types. These include, for example, focused light beams, light-emitting diodes, gas lasers, and laser diodes. Lasers are preferred, as their high intensity allows for the use of fine grain silver halide emulsions (e.g., less than 0.20 μm and preferably less than 0.10 μm), which leads to reduced granularity and increased image sharpness. Solid state laser diodes (which currently emit only in the infrared region of the spectrum) are especially preferred, as they tend to have a higher signal to noise ratio than the gas lasers, and greater reliability and compactness. The present invention is especially useful when laser diodes are the exposure sources because the limitation on their intensity ranges, which are generally less than 2.0 log E units, necessitates the use of high gamma silver halide emulsion units that are incompatible with making matching or reduced contrast copies using prior art processes.

FIG. 7 describes a process and apparatus based on well-known digital image processing technology. The digital technology shown in FIG. 7 offers significant advantages, such as ease of calibration, storage of image data, and compatibility with other digital image processing systems, and is preferred. Other known image processing techniques may also be used, however, as would be apparent to one skilled in the art. For example, the image data modification represented by curves 52 and 62 in FIGS. 5 and 6 may be a simple analog circuit that would perform the function of the analog to digital converters 72, computer 86, look-up tables 76, and digital to analog converters 80 of FIG. 7.

The invention has been described in detail with reference to preferred embodiments thereof. It should be understood, however, that variations and modifications can be made within the spirit and scope of the invention.

What is claimed is:

1. A process for recording a positive or negative continuous tone color copy of a continuous tone original image, comprising the steps of:

providing a photographic element comprising a support having thereon a silver halide emulsion unit capable of forming a yellow image, a silver halide emulsion unit capable of forming a cyan image, and a silver halide emulsion unit capable of forming a magenta image, each image-forming unit having a maximum spectral sensitivity at a different wavelength of radiation, and at least one of the image-forming units having a gamma of greater than about 1.5, receiving image data representing the densities of the yellow, magenta, and cyan records of the original image, modifying said image data and using it to control three exposure sources, each emitting radiation in the region of maximum spectral sensitivity for a corresponding one of the image-forming units, so that after exposure, the recorded image density range for at least one of of the yellow, magenta, and cyan image-forming units is substantially the same as the image density range for the corresponding yellow, magenta, and cyan records, respectively, of said original image, and exposing said photographic element to said exposure sources.

2. A process according to claim 1 wherein at least one of said image-forming units has a gamma of greater than about 2.0.

3. A process according to claim 1 wherein said original image is contained in a photographic element having a gamma of between about 0.5 and 1.1 for at least one of its image records.

4. A process according to claim 1 wherein the range of exposure intensity of at least one exposure source for exposing said element less than about 2.0 log exposure units.

5. A process according to claim 1 wherein the range of exposure intensity of at least one exposure source for exposing said element is less than about 1.5 log exposure units.

6. A process according to claim 1 wherein the image separation between the units of at least one set of two image-forming units in said element is less than about 1.7 log exposure units.

7. A process according to claim 1 wherein said modification of the image data is accomplished with the use of a look-up table.

8. A process according to claim 1 wherein said exposure sources are solid state lasers.

9. A process according to claim 8 wherein said lasers emit in the infrared region of the spectrum.

10. A process according to claim 1 wherein said modification of the image data includes color correction by manipulating the minimum density to compensate for unwanted absorbance of one or more of the yellow, cyan, and magenta image dyes in said element, and said photographic element is substantially free of any colored masking coupler compounds.

11. A process according to claim 1 wherein the modified image data is used to control said exposure sources so that the distribution of the differences in image density from the mean value of image density, or the distribution of these differences with reversed sign, for at least one of the yellow, magenta, and cyan image-forming units is substantially the same as the distribution of image density differences from the mean for the corresponding yellow, magenta, and cyan records, respectively, of the original image.

12. A process according to claim 1 wherein said image data is generated by a scanner.

* * * * *